US008201857B2

(12) United States Patent
Tien

(10) Patent No.: US 8,201,857 B2
(45) Date of Patent: Jun. 19, 2012

(54) ADJUSTABLE DRIVING MECHANISM FOR PANIC EXIT DOOR LOCK

(75) Inventor: Hung-Jen Tien, Tainan (TW)

(73) Assignee: I-Tek Metal Mfg. Co., Ltd., Tainan (TW)

( * ) Notice: Subject to any disclaimer, the term of this patent is extended or adjusted under 35 U.S.C. 154(b) by 346 days.

(21) Appl. No.: 12/749,746

(22) Filed: Mar. 30, 2010

(65) Prior Publication Data

US 2011/0239712 A1 Oct. 6, 2011

(51) Int. Cl.
*E05B 65/10* (2006.01)

(52) U.S. Cl. ..... 292/92; 292/93; 292/94; 70/92

(58) Field of Classification Search ..... 292/92, 292/93, 94, DIG. 65
See application file for complete search history.

(56) References Cited

U.S. PATENT DOCUMENTS

2009/0266120 A1 10/2009 Tien ..... 70/107

*Primary Examiner* — Thomas Beach
*Assistant Examiner* — Nathan Cumar
(74) *Attorney, Agent, or Firm* — Alan Kamrath; Kamrath IP Lawfirm, PA

(57) ABSTRACT

A door lock includes a bracket fixed to a door. An engaging member is pivotably mounted to the bracket. A draw member includes a first end pivotably connected to the engaging member and a second end operably connected to a retractor. A linking rod is connected between the draw member and an operative member mounted to the door such that operation of the operative member causes movement of the linking rod and pivotal movement of the draw member, which in turn, urges the retractor to move a latch bolt from an extended position to a retracted position. A follower is coupled to the first end of draw member to move therewith. An adjusting member is in threading connection with the follower and rotatable to move the follower relative to the engaging member to adjust a position of the second end of the draw member relative to the retractor.

14 Claims, 10 Drawing Sheets

ADJUSTABLE DRIVING MECHANISM FOR PANIC EXIT DOOR LOCK

BACKGROUND OF THE INVENTION

The present invention relates to a driving mechanism for a door lock and, more particularly, to an adjustable driving mechanism for a panic exit door lock.

A typical panic exit door lock mounted to a panic exit door includes a press bar mounted to a side of the panic exit door and a lock body inside the panic exit door. The lock body includes a latch bolt movable between an extended, latching position and a retracted, unlatching position and a retractor for moving the latch bolt from the extended position to the retracted position. A driving mechanism is operably connected between the latch bolt and the press bar. The driving mechanism includes a draw member abutting the retractor. When the press bar is pressed, the draw bar urges the retractor to move, causing retraction of the latch bolt. However, in a case that the driving mechanism is installed in a position such that a spacing exists between the draw member and the retractor, the draw member travels idly through the spacing without moving the retractor when the press member is pressed. As a result, the latch bolt can not move to its fully retracted, unlatching position, adversely affecting operation of the door and requiring troublesome reinstallation of the driving mechanism.

U.S. Patent Publication No. 2009/0266120 A1 discloses an adjustable driving mechanism to solve this problem. The adjustable driving mechanism includes a bracket fixed to a door. A draw member includes a first end pivotably connected to the bracket and a second end connected to a retractor. A linking rod is connected between the draw member and an operative member mounted to the door such that operation of the operative member causes movement of the linking rod and pivotal movement of the draw member, which in turn, urges the retractor to move a latch bolt from an extended position to a retracted position. A follower is movably mounted to the linking rod. An adjusting member is in threading connection with the follower and rotatable to move the follower relative to the linking rod to adjust a position of the second end of the draw member relative to the retractor. However, unlatching operation of the operative member is not force-saving and not smooth. Specifically, the first end of the draw member is not movably connected to the bracket, and a spacing between a pivot point defined in the first end of the draw member and a force applying point defined by a coupling point of the linking rod and the draw member is much smaller than a spacing between the force applying point and a contact point of the second end of the draw member and the retractor, so that a user has to apply large force to press the operative member to move the latch bolt from the extended position to the retracted position, causing inconvenient operation for unlatching the latch bolt.

Thus, a need exists for an adjustable driving mechanism for a panic exit door lock such that the position of the draw member relative to the retractor can be adjusted to avoid troublesome reinstallation of the driving mechanism while allowing easy and smooth unlatching operation.

BRIEF SUMMARY OF THE INVENTION

The present invention solves this need and other problems in the field of panic exit door locks by providing, in a preferred form, a door lock including a case adapted to be mounted in a door. A latch bolt is movable between a retracted position inside the case and an extended position outside the case. A retractor is mounted in the case and operably connected to the latch bolt for moving the latch bolt from the extended position to the retracted position. A bracket is adapted to be fixed to the door and includes first and second sidewalls spaced along a first axis. An engaging member includes first and second ends spaced along a longitudinal axis of the engaging member. The second end of the engaging member is pivotably connected between the first and second sidewalls of the bracket about a first pivot axis parallel to the first axis. The first and second ends of the engaging member are spaced along a second axis perpendicular to the first axis. The engaging member further includes upper and lower sidewalls spaced along the first axis and defining a space therebetween. The upper and lower sidewalls include aligned slots extending between the first and second ends of the engaging member along the longitudinal axis of the engaging member. A draw member includes first and second ends spaced along a third axis perpendicular to the first and second axes. The second end of the draw member is operably connected to the retractor. The first end of draw member has a pin hole. The draw member further includes a pivotal hole between the first and second ends of the draw member. A first pin slideably extends through the slots of the engaging member along the second axis and extends through the pin hole of the draw member. A linking rod includes a first end having a through-hole. The linking rod further includes a second end spaced from the first end of the linking rod along the second axis and adapted to be operably connected to an operative member mounted to the door such that operation of the operative member causes movement of the linking rod. A second pin extends through the pivotal hole of the draw member and the through-hole of the linking rod such that movement of the linking rod in an unlatching direction causes pivotal movement of the draw member about a second pivot axis defined by the first pin, which, in turn, causes movement of the retractor to move the latch bolt from the extended position to the retracted position. A follower is movably received in the space between the upper and lower sidewalls of the engaging member along the longitudinal axis of the engaging member. The follower is coupled to the first pin to move therewith. An adjusting member is rotatably supported by the engaging member and in threading connection with the follower. The adjusting member is rotatable to move the follower and the first pin relative to the engaging member along the second axis and to move the pin along the slots of the engaging member, adjusting a position of the second end of the draw member relative to the retractor along the second axis.

In the most preferred form, the linking rod further includes an intermediate portion intermediate the first and second ends of the linking rod. The door lock further includes a limiting member having first and second sections spaced along the third axis. The first section of the limiting member is pivotably connected to the second end of the engaging member about the first pivot axis. The second section of the limiting member is pivotably connected to the intermediate portion of the linking rod about a third pivot axis parallel to the first pivot axis. The engaging member further includes an engaging hole extending along the longitudinal axis of the engaging member. The follower includes a hole through which the first pin extends. The adjusting member includes a threaded shank extending through the engaging hole of the engaging member and a screw hole of the follower such that rotation of the threaded shank causes movement of the follower and the first pin along the second axis to adjust the position of the second end of the draw member relative to the retractor along the second axis. A spacing between a center of the pivotal hole of the draw member and a center of the pin hole of the draw member is larger than a spacing between the center of the pivotal hole of the draw member and the second end of the draw member.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
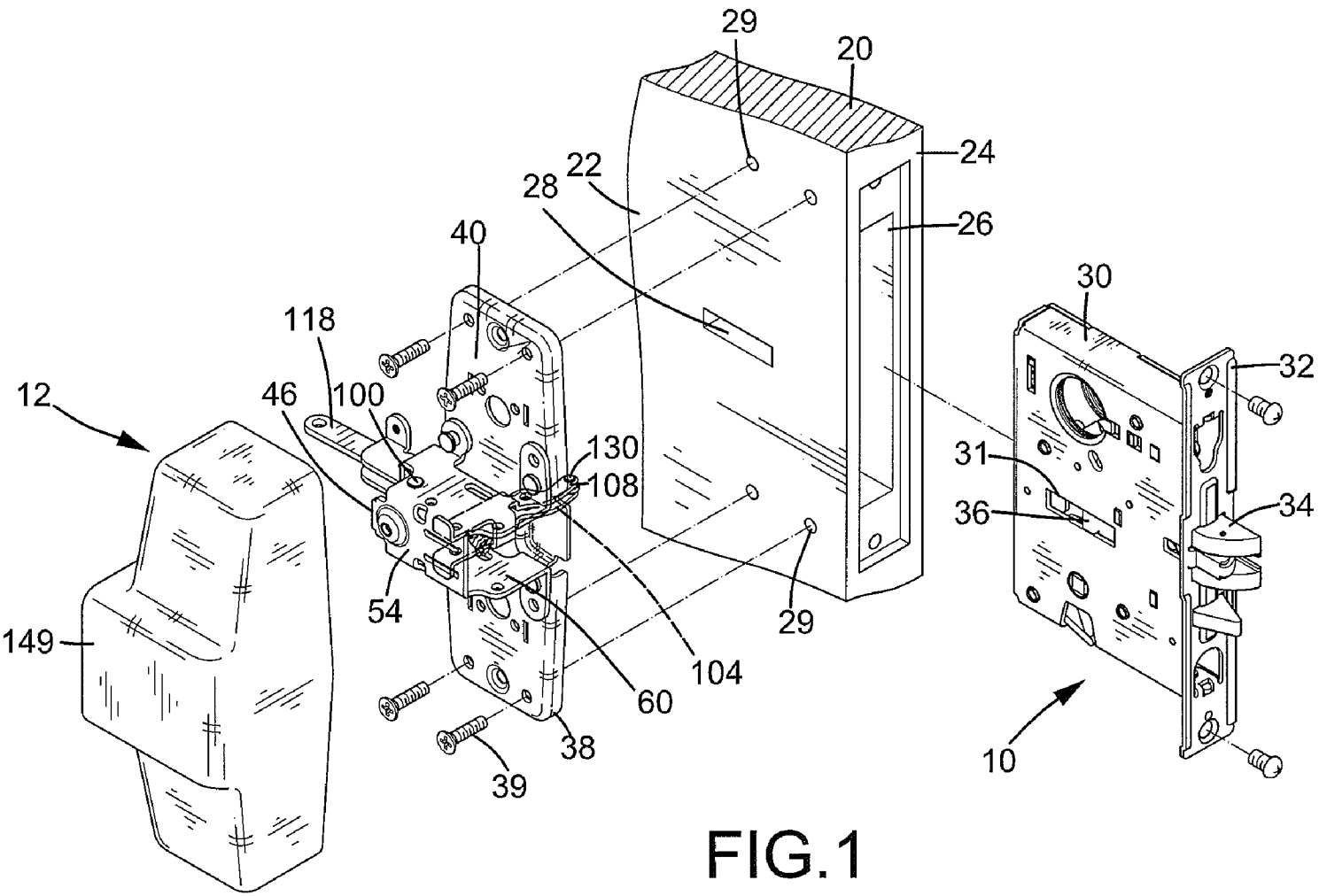
FIG. 1 shows a diagrammatic exploded, perspective view of a panic exit door and a door lock utilizing an adjustable driving mechanism according to the preferred teachings of the present invention.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "fourth", "side", "end", "portion", "section", "longitudinal", "angularly", "inner", "outer", "spacing", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

Figure 2:
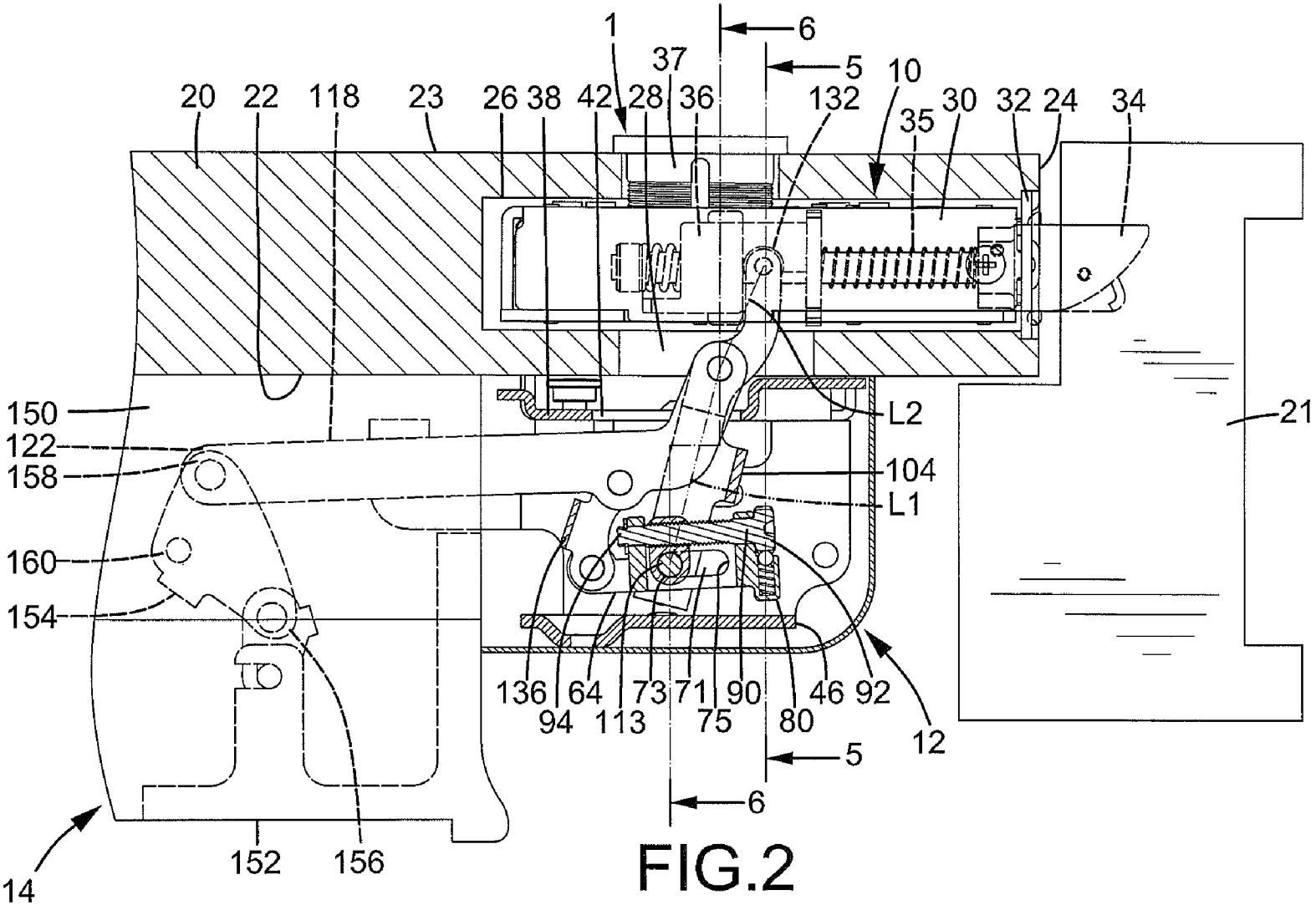
FIG. 2 shows a partial, cross sectional view of the door lock and the door of FIG. 1 with a latch bolt in an extended position.
Figure 3:
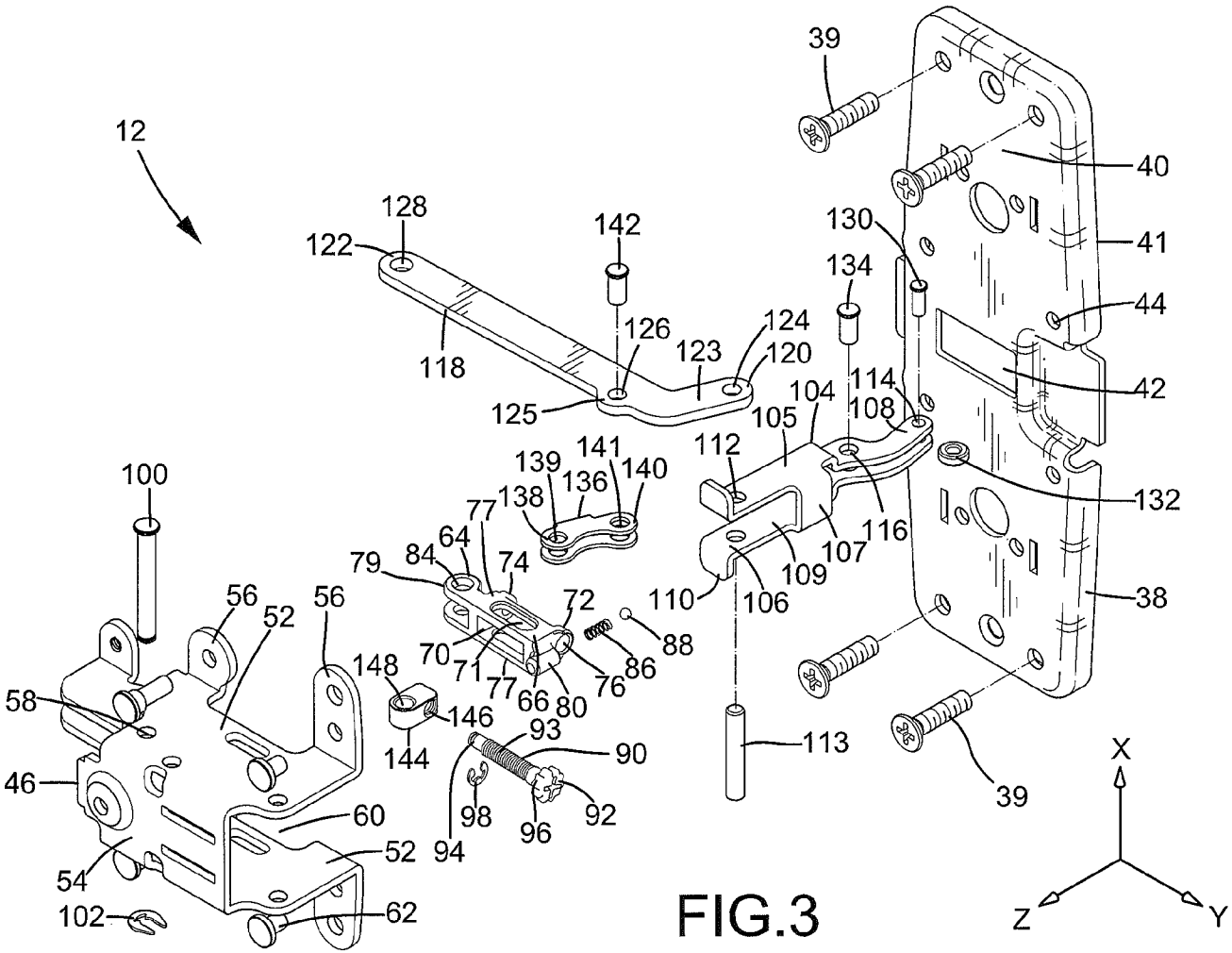
FIG. 3 shows a partial, exploded, perspective view of the driving mechanism of FIG. 1.

An adjustable driving mechanism according to the preferred teachings of the present invention is shown in the drawings and generally designated 12. According to the preferred form shown, adjustable driving mechanism 12 is utilized with a panic exit door lock 1 mounted to a panic exit door 20 having a compartment 26 in an end face 24 of door 20 for receiving a lock body 10 of door lock 1. Door 20 has an opening 28 in an inner side 22 thereof and in communication with compartment 26. A plurality of positioning holes 29 is provided in door 20. Lock body 10 includes a case 30 having a slot 31 in an inner side thereof and aligned with opening 28. Lock body 10 further includes a latch bolt 34 movable between a retracted position inside case 30 and an extended position outside case 30. Furthermore, lock body 10 includes a retractor 36 mounted in case 30 for moving latch bolt 34 from the extended position to the retracted position. Latch bolt 34 is normally biased to the extended position, and a locking effect is provided when latch bolt 34 in the extended position is received in a side frame 21 of door 20 (FIG. 2). A spring 35 is attached to latch bolt 34 for returning purposes. A lock core 37 is mounted to an outer side 23 of door 20 and operably connected to retractor 36. A key can be inserted into lock core 37 and turned to move retractor 36 for retracting latch bolt 34.

According to the preferred form shown, door lock 1 utilizing adjustable driving mechanism 12 according to the preferred teachings of the present invention further includes an inner operating device 14 operable to retract latch bolt 34 via retractor 36. Inner operating device 14 can be of any desired form as conventional including but not limited to of a commercially available type. According to the preferred form shown, inner operating device 14 includes a housing 150 attached to inner side 22 of door 20, and an operative member 152 in the most preferred form shown as a press bar is pivotably coupled to housing 150. A rocker 154 is mounted in housing 150 and includes a first corner 156 pivotably connected to operative member 152, a second corner 158 pivotably connected to driving mechanism 12, and a third corner 160 pivotably connected to housing 150. When operative member 152 is operated (e.g., pressed), rocker 154 pivots about third corner 160 to drive driving mechanism 12 for retracting latch bolt 34.

According to the preferred form shown, driving mechanism 12 includes a base 38 having opposite first and second sides 40 and 41 and a through-hole 42 extending from first side 40 through second side 41 and aligned with opening 28 of door 20. Base 38 further includes a plurality of fixing holes 44 through which fasteners 39 are extended into positioning holes 29 of door 20 so that base 38 is fixed to inner side 22 of door 20.

According to the preferred form shown, driving mechanism 12 further includes a bracket 46 fixed by fasteners 62 to first side 40 of base 38. Bracket 46 is substantially U-shaped in section and includes parallel, spaced first and second sidewalls 52 spaced along a first axis X and an interconnecting wall 54 interconnected between first and second sidewalls 52, defining a space 60 therebetween. Each of first and second sidewalls 52 includes a plurality of engaging portions 56 through which fasteners 62 are extended into fixing holes 44 of base 38. First and second sidewalls 52 of bracket 46 further include aligned pin holes 58 extending along first axis X.

Figure 4:
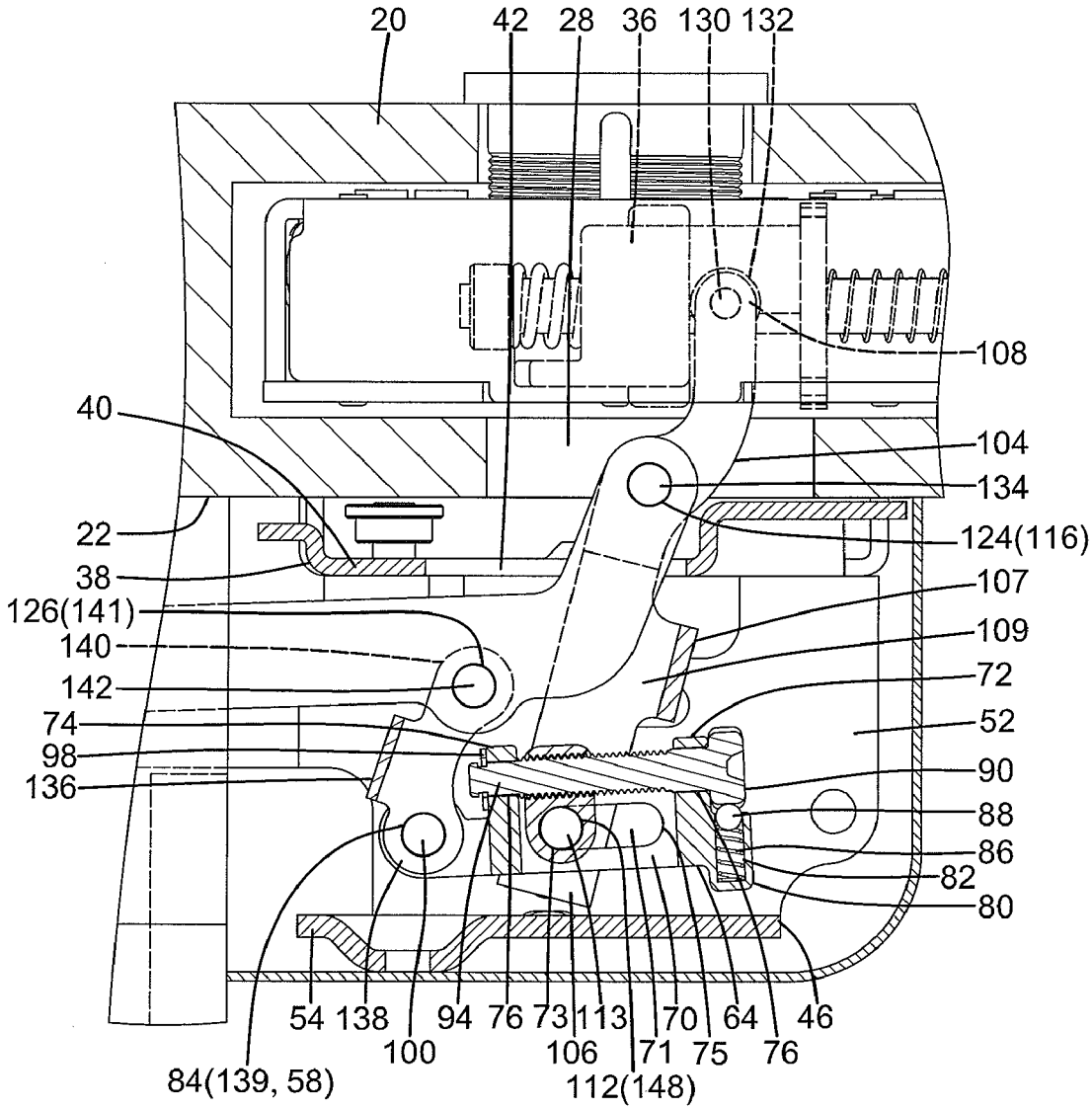
FIG. 4 shows a cross sectional view of the door lock and the door of FIG. 1.

According to the preferred form shown, driving mechanism 12 further include an engaging member 64 having first and second ends 66 and 68 spaced along a longitudinal axis of engaging member 64. Engaging member 64 is received in space 60 of bracket 46 with first and second ends 66 and 68 of engaging member 64 spaced along a second axis Y perpendicular to first axis X after engaging member 64 is mounted in bracket 46. Second end 68 of engaging member 64 includes two lugs 79 spaced along first axis X and having aligned through-holes 84 extending along first axis X. A pin 100 extends through pin holes 58 of bracket 46 and through-holes 84 of engaging member 64 so that second end 68 of engaging member 64 is pivotably connected between first and second sidewalls 52 of bracket 46 about a pivot axis defined by pin 100 and parallel to first axis X. A retainer 102 in the most preferred form shown as a C-clip is mounted on a distal end of pin 100, preventing pin 100 from disengaging from bracket 46. Engaging member 64 further includes upper and lower sidewalls 77 spaced along first axis X and defining a space 70 therebetween. Engaging member 64 further includes first and second engaging portions 72 and 74 spaced along second axis Y and each includes an engaging hole 76 extending along the longitudinal axis of engaging member 64. Upper and lower sidewalls 77 include aligned slots 71 extending between first and second ends 66 and 68 along the longitudinal axis of engaging member 64 and intermediate first and second engaging portions 72 and 74 along the longitudinal axis of engaging member 64. Each slot 71 includes first and second ends 73 and 75 spaced along second axis Y (FIG. 4). Engaging member 64 further includes a sleeve 80 formed on first end 66 and having a receptacle 82 extending perpendicularly to the longitudinal axis of engaging member 64. A positioning ball 88 is received in receptacle 82. A spring 86 is received in receptacle 82 and biases positioning ball 88 away from receptacle 82 so that a portion of positioning ball 88 can be moved out of receptacle 82 (see FIG. 4).

According to the preferred form shown, driving mechanism 12 further includes a follower 144 and an adjusting member 90. Follower 144 is movably received in space 70 between upper and lower sidewalls 77 along the longitudinal axis of engaging member 64. Follower 144 includes a hole 148 extending along first axis X and a screw hole 146 spaced from hole 148 and extending along second axis Y. Adjusting member 90 is rotatably supported by engaging member 64 and in threading connection with follower 144. In the most preferred form, adjusting member 90 is a screw including a head 92 and a threaded shank 93 extending from a side of head 92. Threaded shank 93 extends through engaging holes 76 of first and second engaging portions 72 and 74 and screw hole 146 of follower 144. A retainer 98 in the most preferred form shown as a C-clip is mounted on a distal end 94 of threaded shank 93, preventing movement of adjusting member 90 along second axis Y, but allowing rotation of threaded shank 93. A plurality of angularly spaced recesses 96 is formed on an outer periphery of head 92 such that positioning ball 88 biased by spring 86 can be releasably engaged with one of recesses 96. Head 92 of adjusting member 90 can be turned by a tool such as a screwdriver to impart a rotational force to head 92. When the rotational force overcomes and compresses spring 86, positioning ball 88 is disengaged from recesses 96 to allow rotational movement of threaded shanks 93, which in turn, causes movement of follower 144 along the longitudinal axis of engaging member 64, i.e., along second axis Y.

Figure 5:
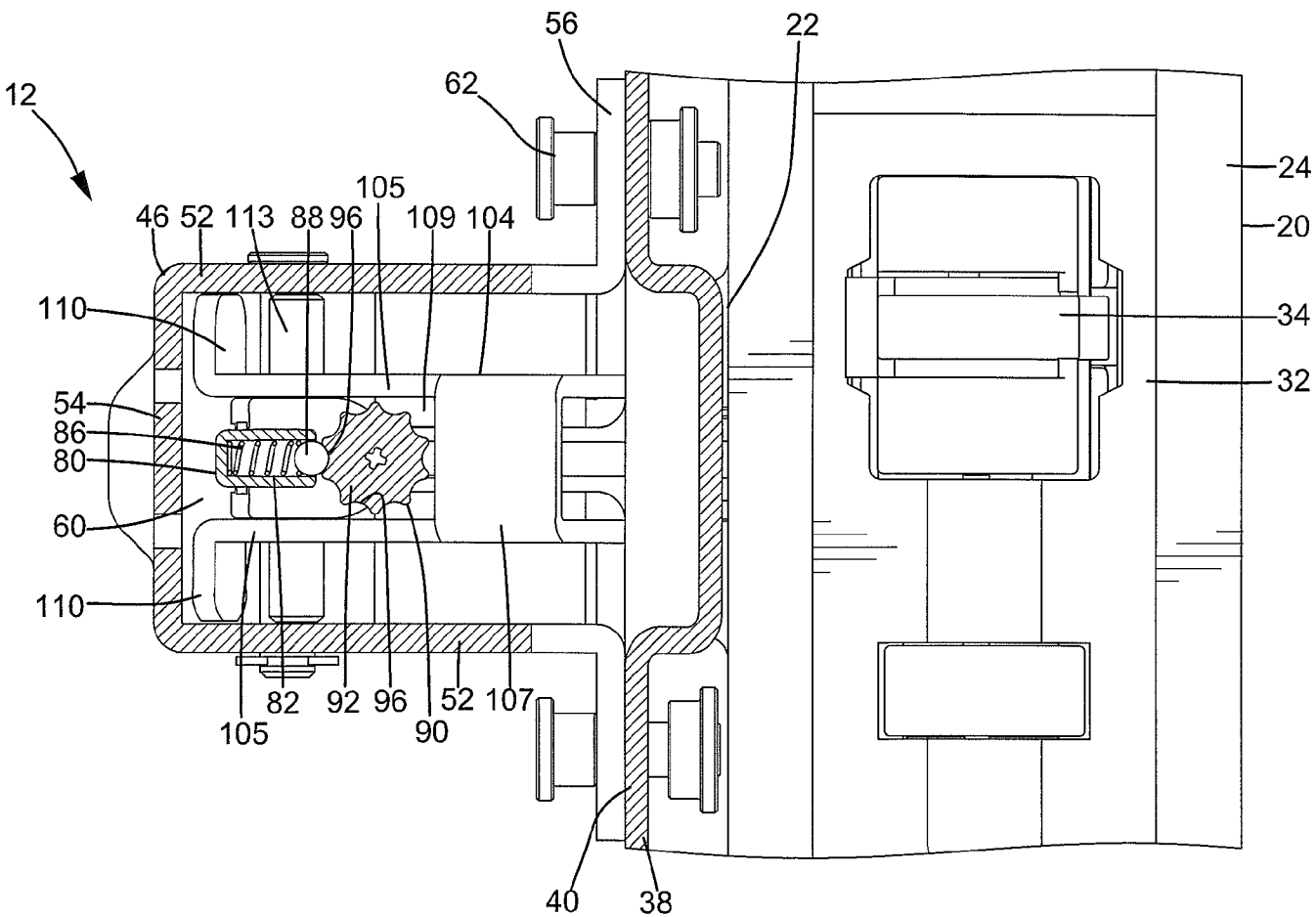
FIG. 5 shows a cross sectional view of the door lock and the door of FIG. 1 according to section line 5-5 of FIG. 2.
Figure 6:
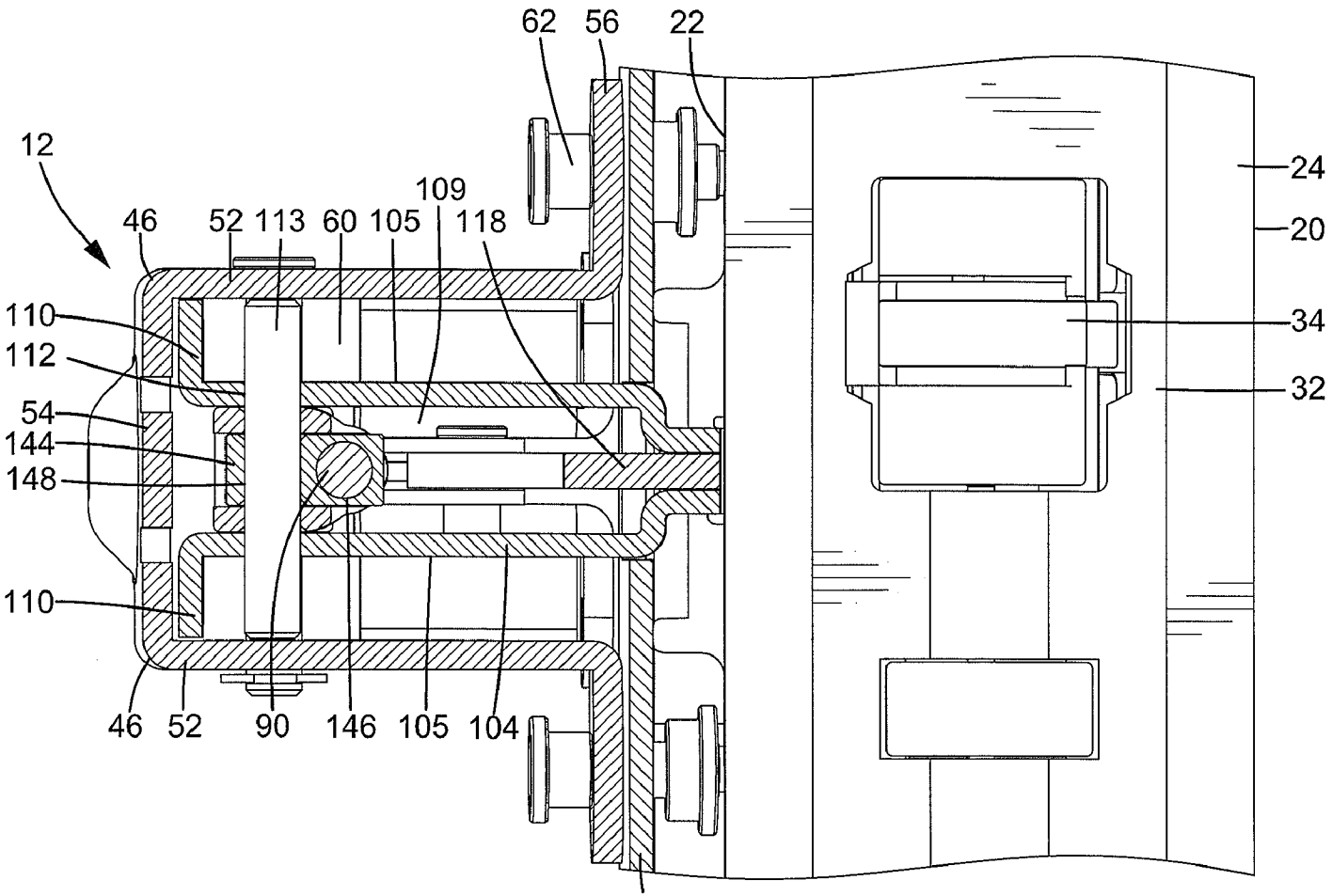
FIG. 6 shows a partial, cross sectional view of the door lock and the door of FIG. 1 according to section line 6-6 of FIG. 2

According to the preferred form shown, driving mechanism 12 further includes a draw member 104 having first and second ends 106 and 108 spaced along a third axis Z perpendicular to first and second axes X and Y. Draw member 104 includes parallel, spaced first and second side plates 105 and an interconnecting plate 107 interconnected between intermediate portions of first and second side plates 105, defining an opening 109 therebetween. Engaging member 64 is received between first and second side plates 105 of first end 106 of draw member 104. First and second side plates 105 of first end 106 of draw member 104 include aligned wings 110 extending away from each other along first axis X and aligned pin holes 112 extending along first axis X. First end 106 of draw member 104 is received between first and second sidewalls 52 of bracket 46 with wings 110 abutting first and second sidewalls 52 of bracket 46 (FIG. 5). A pin 113 is extended through pin holes 112 of draw member 104, hole 148 of follower 144, and slideably extended through slots 71 of engaging member 64 along the longitudinal axis of engaging member 64 so that first end 106 of draw member 104 is pivotably received in bracket 46 about a pivot axis defined by pin 113 and can be moved together with pin 113 and follower 144 between first and second ends 73 and 75 of slots 71 of engaging member 64 along the longitudinal axis of engaging member 64 relative to bracket 46. Second end 108 of draw member 104 is slideably extended through through-hole 42 of base 38, opening 28 of door 20, and slot 31 of case 30 and abuts retractor 36. In the most preferred form, first and second side plates 105 of second end 108 of draw member 104 includes aligned pin holes 114. A wheel 132 is received between first and second side plates 105 of second end 108 of draw member 104, and a pin 130 extends through wheel 132 and pin holes 114 of draw member 104 along first axis X so that wheel 132 rotatably abuts retractor 36. Draw member 104 further includes a pivotal hole 116 between first and second ends 106 and 108. A spacing L1 between a center of pivotal hole 116 of draw member 104 and a center of pin hole 112 of draw member 104 is larger than a spacing L2 between the center of pivotal hole 116 of draw member 104 and a pivot axis defined by pin 130 (FIG. 2).

Figure 7:
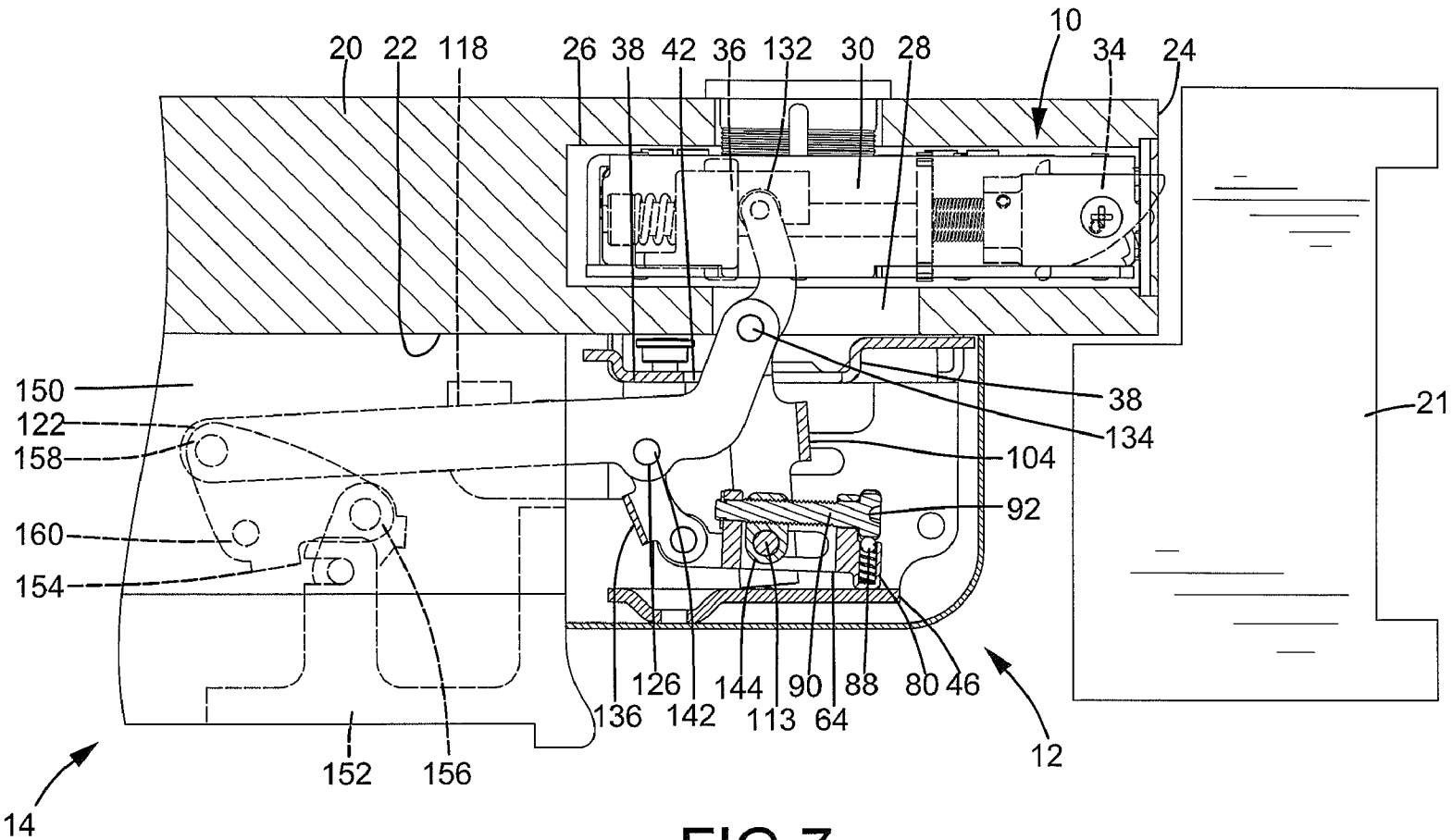
FIG. 7 shows a partial, cross sectional view of the door lock and the door of FIG. 1 with the latch bolt in a retracted position.

According to the preferred form shown, driving mechanism 12 further includes a linking rod 118 movably extending between first and second sidewalls 52 of bracket 46. Linking rod 118 includes first and second ends 120 and 122 spaced along second axis Y, and an intermediate portion 125 intermediate first and second ends 120 and 122. In the most preferred form shown, linking rod 118 includes a first arm having a distal end forming first end 120. Linking rod 118 further includes a second arm at an obtuse angle to the first arm and extending from an end of the first arm and having a distal end forming second end 122. Linking rod 118 further includes a first through-hole 124 in first end 120, a second through-hole 128 in second end 122, and a third through-hole 126 in intermediate portion 125. A spacing between a center of third through-hole 126 and a center of second through-hole 128 is larger than a spacing between the center of third through-hole 126 and a center of first through-hole 124. Second end 122 of linking rod 118 is pivotably connected to second corner 158 of rocker 154 by a pin extending through second through-hole 128 and second corner 158 such that operation of operative member 152 causes movement of linking rod 118 relative to bracket 46 along second axis Y. A pin 134 extends through pivotal hole 116 of draw member 104 and first through-hole 124 of linking rod 118 such that movement of linking rod 118 in an unlatching direction causes pivotal movement of draw member 104 about a pivot axis defined by pin 113, which, in turn, causes movement of retractor 36 to move latch bolt 34 from the extended position to the retracted position. Namely, second end 108 of draw member 104 presses against retractor 36 and urges retractor 36 to move inward to retract latch bolt 34 (see FIG. 7). Latch bolt 34 returns its extended position (see FIG. 2) under action of spring 35 when operative member 152 is released.

According to the preferred form shown, driving mechanism 12 further includes a limiting member 136 having first and second sections 138 and 140 spaced along third axis Z. First section 138 of limiting member 136 includes a first engaging hole 139 through which pin 100 extends so that first section 138 of limiting member 136 is pivotably connected to second end 68 of engaging member 64 about the pivot axis defined by pin 100. Second section 140 of limiting member 136 includes a second engaging hole 141. A pin 142 extends through third through-hole 126 of linking rod 118 and second engaging hole 141 of limiting member 136 so that second section 140 of limiting member 136 is pivotably connected to intermediate portion 125 of linking rod 118 about a pivot axis defined by pin 142. Furthermore, a cover 149 is mounted to base 38 to cover the whole driving mechanism 12. It can be appreciated that opening 109 of draw member 104 allows free pivotal movement of first end 106 of draw member 104 relative to follower 144.

Figure 8:
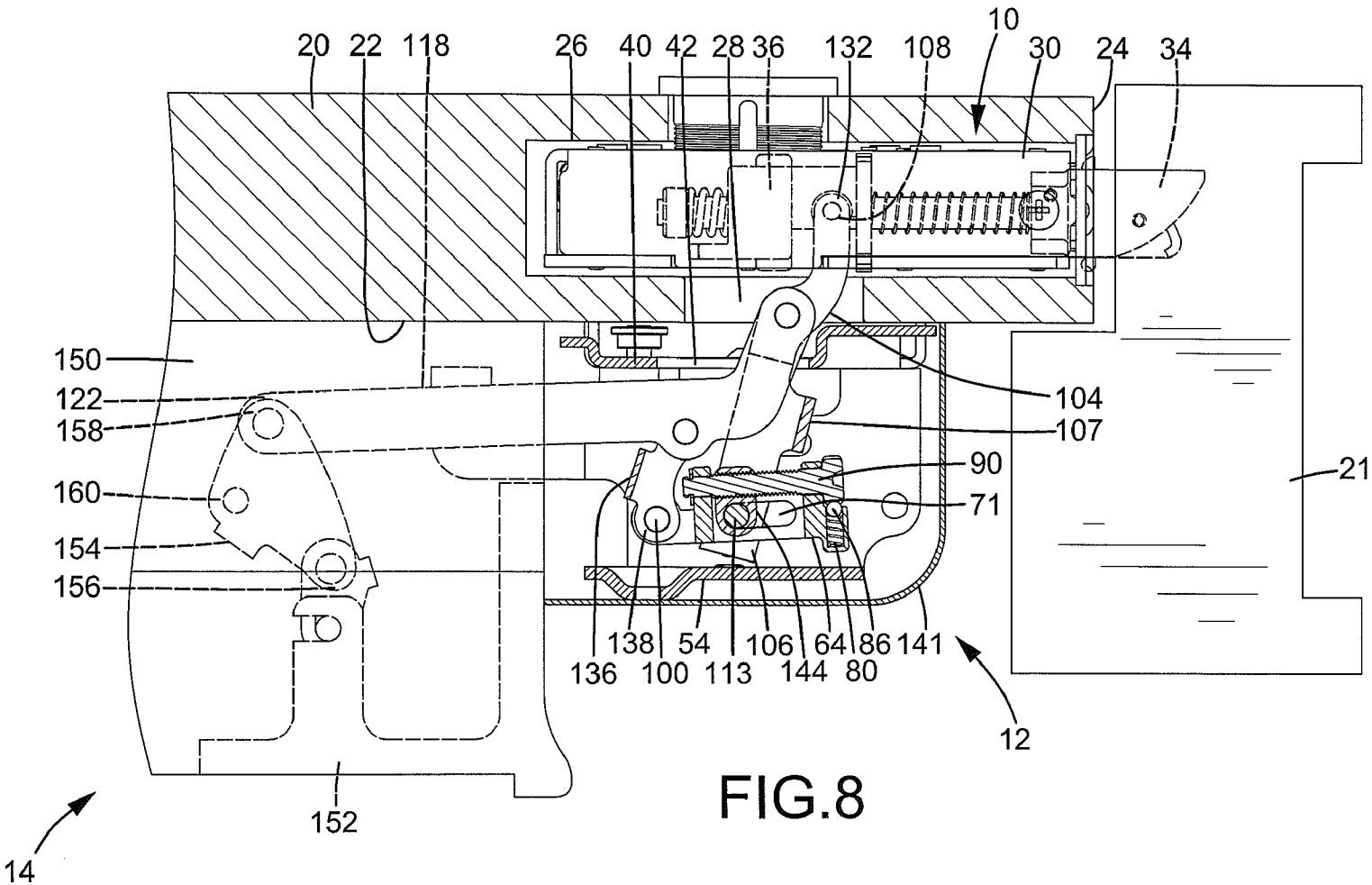
FIG. 8 shows a partial, cross sectional view of the door lock and the door of FIG. 1 with the driving mechanism installed in a position spaced from a retractor and with the latch bolt in an extended position.
Figure 9:
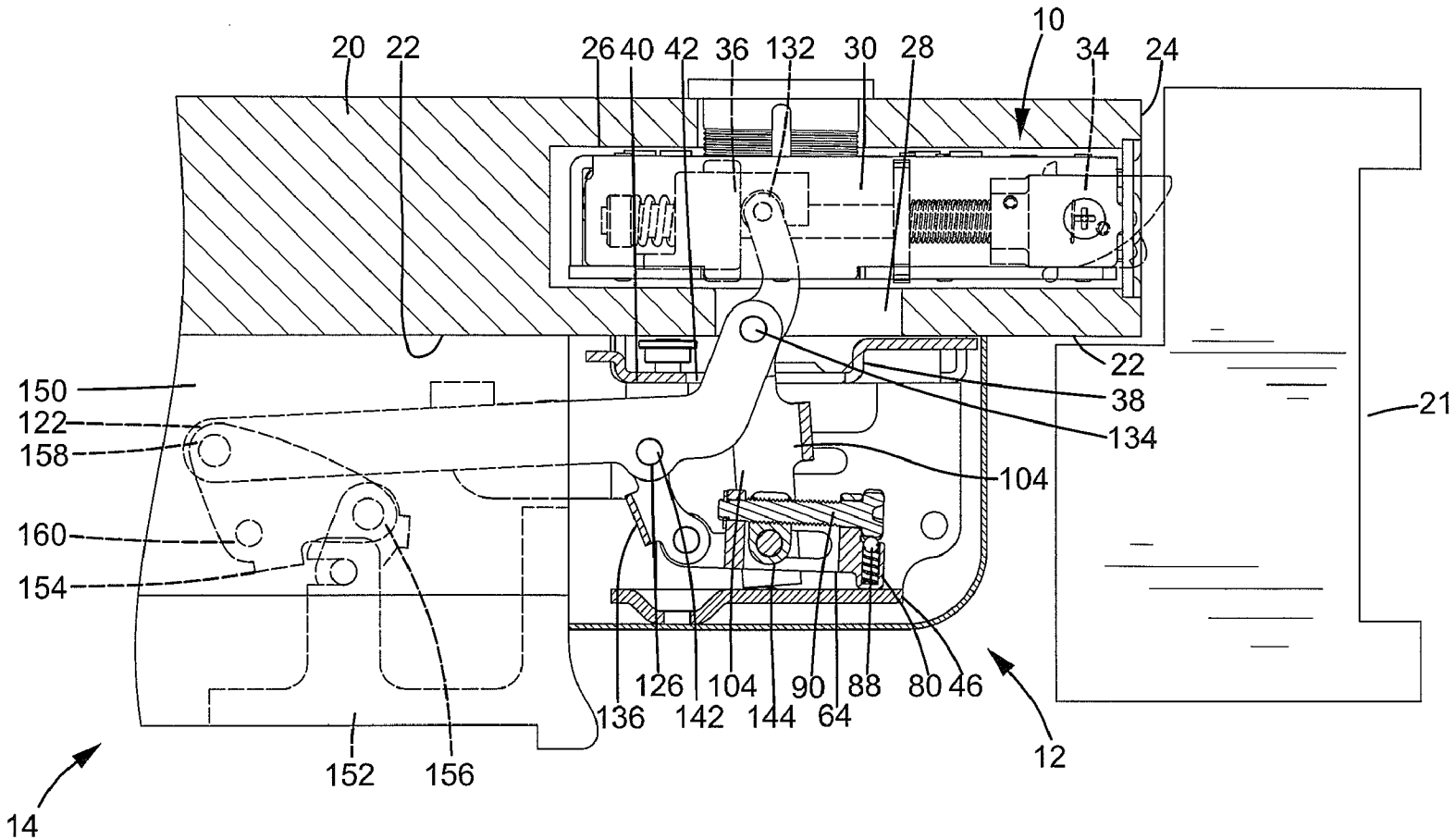
FIG. 9 shows a partial, cross sectional view of the door lock and the door of FIG. 8 with the latch bolt in a retracted position.

However, in a case that the driving mechanism 12 is mounted in a position too close to side frame 21 (see FIG. 8), a spacing exists between second end 108 of draw member 104 and retractor 36 such that, when operative member 152 is operated, draw member 104 has an idle travel before its second end 108 comes in contact with retractor 36. Thus, latch bolt 34 can not be moved to its fully retracted position inside case 30, failing to unlatch door 20 (see FIG. 9).

Figure 10:
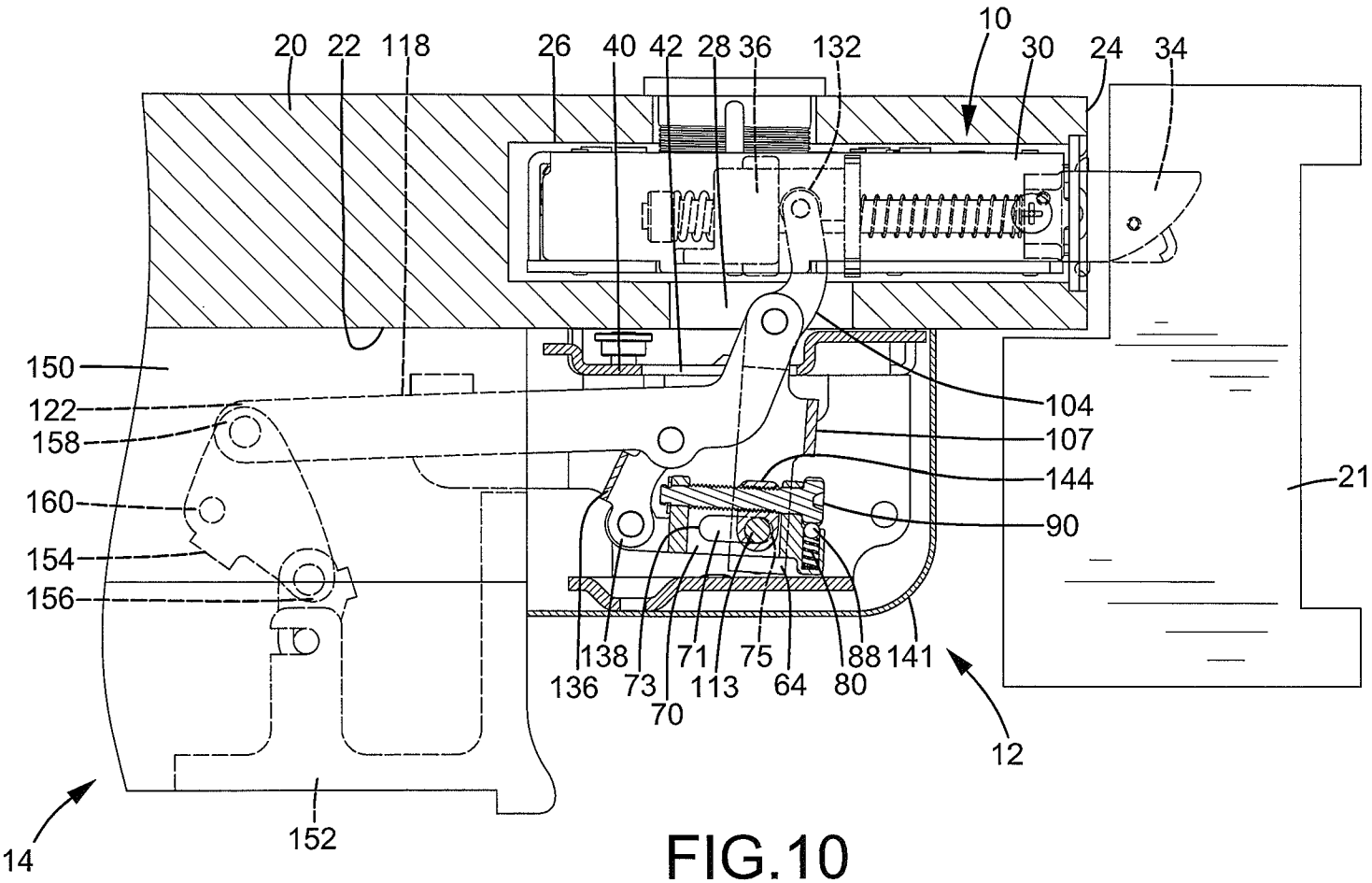
FIG. 10 shows a cross sectional view of the door lock and the door of FIG. 8 with the driving mechanism adjusted to a position abutting the retractor.

In this case, as mentioned above, head 92 of adjusting member 90 can be turned by a tool to impart a rotational force to head 92. When the rotational force compresses spring 86, positioning ball 88 is disengaged from recesses 96 to allow rotational movement of threaded shank 93. When threaded shank 93 of adjusting member 90 is rotated, follower 144 and pin 113 are moved relative to engaging member 64 along the longitudinal axis of engaging member 64, and engaging member 64 pivots about the pivot axis defined by pin 100. Slots 71 are elongated to allow movement of pin 113 along the longitudinal axis of engaging member 64. Movement of pin 113 causes pivotal movement of draw member 104 about a pivot axis defined by pin 134 until wheel 132 in second end 108 of draw member 104 abuts retractor 36, adjusting a position of second end 108 of draw member 104 relative to retractor 36 along second axis Y (see FIG. 10). Thus, the idle travel of draw member 104 is eliminated. Namely, latch bolt 34 can be effectively retracted when operative member 152 is operated. Reinstallation of driving mechanism 12 is, thus, not required.

According to the preferred form shown, spacing L1 between the center of pivotal hole 116 of draw member 104 and the center of pin hole 112 of draw member 104 is about 40.67 mm, while spacing L2 between the center of pivotal hole 116 of draw member 104 and a pivot axis defined by pin 130 is about 22 mm. According to the leverage arrangement, a user can apply small force to press operative member 152 to move latch bolt 34 from the extended position to the retracted position, obtaining force-saving effect with less effort. Furthermore, first end 106 of draw member 104 is movably connected to engaging member 64, further enhancing operational smoothness for unlatching latch bolt 34.

Now that the basic teachings of the present invention have been explained, many extensions and variations will be obvious to one having ordinary skill in the art. For example, bracket 46 can be directly mounted to door 20 without base 38. Furthermore, driving mechanism 12 does not have to include limiting member 136, although limiting member 136 provides a more reliable operational effect. Furthermore, first and second engaging portions 72 and 74 of engaging member 64 can be portions of a single engaging portion having a single engaging hole 76 extending along the longitudinal axis of engaging member 64. Further, driving mechanism 12 according to the preferred teachings of the present invention can be utilized with door locks of other forms. For example, operative member 152 can be replaced with other functionally equivalent members for moving linking rod 118 for the purposes of retracting latch bolt 34.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A door lock comprising:

a case (30) adapted to be mounted in a door (20);

a latch bolt (34) movable between a retracted position inside the case (30) and an extended position outside the case (30);

a retractor (36) mounted in the case (30) and operably connected to the latch bolt (34) for moving the latch bolt (34) from the extended position to the retracted position;

a bracket (46) adapted to be fixed to the door (20) and including first and second sidewalls (52) spaced along a first axis (X);

an engaging member (64) including first and second ends (66, 68) spaced along a longitudinal axis of the engaging member (64), with the second end (68) of the engaging member (64) being pivotably connected between the first and second sidewalls (52) of the bracket (46) about a first pivot axis parallel to the first axis (X), with the first and second ends (66, 68) of the engaging member (64) spaced along a second axis (Y) perpendicular to the first axis (X), with the engaging member (64) further including upper and lower sidewalls (77) spaced along the first axis (X) and defining a space (70) therebetween, with the upper and lower sidewalls (77) including aligned slots (71) extending between the first and second ends (66, 68) of the engaging member (64) along the longitudinal axis of the engaging member (64);

a draw member (104) including first and second ends (106, 108) spaced along a third axis (Z) perpendicular to the first and second axes (X, Y), with the second end (108) of the draw member (104) operably connected to the retractor (36), with the first end (106) of the draw member (104) having a first pin hole (112), with the draw member (104) further including a pivotal hole (116) between the first and second ends (106, 108) of the draw member (104);

a first pin (113) slideably extending through the slots (71) of the engaging member (64) along the second axis (Y) and extending through the first pin hole (112) of the draw member (104);

a linking rod (118) including a first end (120) having a through-hole (124), with the linking rod (118) further including a second end (122) spaced from the first end (120) of the linking rod (118) along the second axis (Y) and adapted to be operably connected to an operative member (152) mounted to the door (20) such that operation of the operative member (152) causes movement of the linking rod (118);

a second pin (134) extending through the pivotal hole (116) of the draw member (104) and the through-hole (124) of the linking rod (118) such that movement of the linking rod (118) in an unlatching direction causes pivotal movement of the draw member (104) about a second pivot axis defined by the first pin (113), which, in turn, causes movement of the retractor (36) to move the latch bolt (34) from the extended position to the retracted position;

a follower (144) movably received in the space (70) between the upper and lower sidewalls (77) of the engaging member (64) along the longitudinal axis of the engaging member (64), with the follower (144) coupled to the first pin (113) to move therewith; and an adjusting member (90) rotatably supported by the engaging member (64) and in threading connection with the follower (144), with the adjusting member (90) being rotatable to move the follower (144) and the first pin (113) relative to the engaging member (64) along the second axis (Y) and to move the pin (113) along the slots (71) of the engaging member (64), adjusting a position of the second end (108) of the draw member (104) relative to the retractor (36) along the second axis (Y).

2. The door lock as claimed in claim 1, with the engaging member (64) further including first and second engaging portions (72, 74) spaced along the second axis (Y) and each including an engaging hole (76) extending along the longitudinal axis of the engaging member (64), with the slots (71) intermediate the first and second engaging portions (72, 74) along the longitudinal axis of the engaging member (64), with the follower (144) including a hole (148) through which the first pin (113) extends, with the follower (144) further including a screw hole (146), with the adjusting member (90) including a threaded shank (93) extending through the engaging holes (76) of the first and second engaging portions (72, 74) and the screw hole (146) of the follower (144) such that rotation of the threaded shank (93) causes movement of the follower (144) and the first pin (113) along the second axis (Y) to adjust the position of the second end (108) of the draw member (104) relative to the retractor (36) along the second axis (Y).

3. The door lock as claimed in claim 2, with the adjusting member (90) further including a head (92) from which the threaded shank (93) extends, with the head (92) including a plurality of angularly spaced recesses (96) and being adapted to be driven by a tool to rotate the threaded shank (93), with the engaging member (64) further including a sleeve (80) formed on the first end (66) of the engaging member (64), with the sleeve (80) having a receptacle (82) extending perpendicularly to the longitudinal axis of the engaging member (64), with the door lock further comprising, in combination: a positioning ball (88) received in the receptacle (82); and a spring (86) received in the receptacle (82) and biasing the positioning ball (88) away from the receptacle (82), with a portion of the positioning ball (88) protruding out of the receptacle (82) and releasably engaged with one of the plurality of recesses (96), and with the positioning ball (88) being disengaged from the plurality of recesses (96) when a rotational force is applied to the head (92) and compresses the spring (86).

4. The door lock as claimed in claim 3, with the second end (68) of the engaging member (64) including two lugs (79) spaced along the first axis (X) and having aligned through-holes (84) extending along the first axis (X), with the first and second sidewalls (52) of the bracket (46) including aligned second pin holes (58) extending along the first axis (X), with the door lock further comprising, in combination: a third pin (100) defining the first pivot axis and extending through the second pin holes (58) of the bracket (46) and the through-holes (84) of the engaging member (64), and with the engaging member (64) pivoting about the first pivot axis when the adjusting member (90) rotates.

5. The door lock as claimed in claim 4, with the linking rod (118) further including an intermediate portion (125) intermediate the first and second ends (120, 122) of the linking rod (118), with the door lock further comprising, in combination: a limiting member (136) including first and second sections (138, 140) spaced along the third axis (Z), with the first section (138) of the limiting member (136) being pivotably connected to the second end (68) of the engaging member (64) about the first pivot axis, with the second section (140) of limiting member (136) being pivotably connected to the intermediate portion (125) of the linking rod (118) about a third pivot axis parallel to the first pivot axis.

6. The door lock as claimed in claim 5, with a spacing between a center of the pivotal hole (116) of the draw member (104) and a center of the first pin hole (112) of the draw member (104) being larger than a spacing between the center of the pivotal hole (116) of the draw member (104) and the second end (108) of the draw member (104).

7. The door lock as claimed in claim 6, with the draw member (104) including parallel, spaced first and second side plates (105) and an interconnecting plate (107) interconnected between intermediate portions of the first and second side plates (105), with the engaging member (64) pivotably received between the first and second side plates (105) of the first end (106) of the draw member (104), with the first and second side plates (105) of the second end (108) of the draw member (104) including aligned third pin holes (114), with the door lock further comprising, in combination: a wheel (132) received between the first and second side plates (105) of the second end (108) of the draw member (104); and a fourth pin (130) extending through the wheel (132) and the third pin holes (114) of the draw member (104) along the first axis (X), with the wheel (132) abutting the retractor (36), and with the spacing between the center of the pivotal hole (116) of the draw member (104) and the center of the first pin hole (112) of the draw member (104) being larger than a spacing between the center of the pivotal hole (116) of the draw member (104) and a fourth pivot axis defined by the fourth pin (130).

8. The door lock as claimed in claim 7, with the linking rod (118) including a first arm and a second arm extending from an end of the first arm and at an obtuse angle to the first arm, with the first arm having a distal end forming the first end (120) of the linking rod (118), and with the second arm having a distal end forming the second end (122) of the linking rod (118).

9. The door lock as claimed in claim 1, with the linking rod (118) further including an intermediate portion (125) intermediate the first and second ends (120, 122) of the linking rod (118), with the door lock further comprising, in combination: a limiting member (136) including first and second sections (138, 140) spaced along the third axis (Z), with the first section (138) of the limiting member (136) being pivotably connected to the second end (68) of the engaging member (64) about the first pivot axis, with the second section (140) of the limiting member (136) being pivotably connected to the intermediate portion (125) of the linking rod (118) about a third pivot axis parallel to the first pivot axis.

10. The door lock as claimed in claim 9, with the engaging member (64) further including an engaging hole (76) extending along the longitudinal axis of the engaging member (64), with the follower (144) including a hole (148) through which the first pin (113) extends, with the follower (144) further including a screw hole (146), with the adjusting member (90) including a threaded shank (93) extending through the engaging hole (76) of the engaging member (64) and the screw hole (146) of the follower (144) such that rotation of the threaded shank (93) causes movement of the follower (144) and the first pin (113) along the second axis (Y) to adjust the position of the second end (108) of the draw member (104) relative to the retractor (36) along the second axis (Y).

11. The door lock as claimed in claim 10, with the adjusting member (90) further including a head (92) from which the threaded shank (93) extends, with the head (92) including a plurality of angularly spaced recesses (96) and being adapted to be driven by a tool to rotate the threaded shank (93), with the engaging member (64) further including a sleeve (80) formed on the first end (66) of the engaging member (64), with the sleeve (80) having a receptacle (82) extending perpendicularly to the longitudinal axis of the engaging member (64), with the door lock further comprising, in combination: a positioning ball (88) received in the receptacle (82) and a spring (86) received in the receptacle (82) and biasing the positioning ball (88) away from the receptacle (82), with a portion of the positioning ball (88) protruding out of the receptacle (82) and releasably engaged with one of the plurality of recesses (96), and with the positioning ball (88) being disengaged from the plurality of recesses (96) when a rotational force is applied to the head (92) and compresses the spring (86).

12. The door lock as claimed in claim 11, with a spacing between a center of the pivotal hole (116) of the draw member (104) and a center of the first pin hole (112) of the draw member (104) being larger than a spacing between the center of the pivotal hole (116) of the draw member (104) and the second end (108) of the draw member (104).

13. The door lock as claimed in claim 12, with the draw member (104) including parallel, spaced first and second side plates (105) and an interconnecting plate (107) interconnected between intermediate portions of the first and second side plates (105), with the engaging member (64) pivotably received between the first and second side plates (105) of the first end (106) of the draw member (104), with the first and second side plates (105) of the second end (108) of the draw member (104) including aligned third pin holes (114), with the door lock further comprising, in combination: a wheel (132) received between the first and second side plates (105) of the second end (108) of the draw member (104); and a third pin (130) extending through the wheel (132) and the third pin holes (114) of the draw member (104) along the first axis (X), with the wheel (132) abutting the retractor (36), and with the spacing between the center of the pivotal hole (116) of the draw member (104) and the center of the first pin hole (112) of the draw member (104) being larger than a spacing between the center of the pivotal hole (116) of the draw member (104) and a fourth pivot axis defined by the third pin (130).

14. The door lock as claimed in claim 13, with the linking rod (118) including a first arm and a second arm extending from an end of the first arm and at an obtuse angle to the first arm, with the first arm having a distal end forming the first end (120) of the linking rod (118), and with the second arm having a distal end forming the second end (122) of the linking rod (118).

* * * * *